US005959265A

United States Patent [19]

Van Ligten

[11] Patent Number: 5,959,265

[45] Date of Patent: Sep. 28, 1999

[54] LAMBDA/4-WAVE SOUND ABSORBER

[75] Inventor: Robert H. Van Ligten, Zurich, Switzerland

[73] Assignee: Rieter Automotive (International) AG, Zollikon, Switzerland

[21] Appl. No.: 08/860,102

[22] PCT Filed: Jan. 4, 1996

[86] PCT No.: PCT/CH96/00002

§ 371 Date: Oct. 6, 1997

§ 102(e) Date: Oct. 6, 1997

[87] PCT Pub. No.: WO96/23294

PCT Pub. Date: Aug. 1, 1996

[30] Foreign Application Priority Data

Jan. 27, 1995 [CH] Switzerland ..... 226/95

[51] Int. Cl.[6] ..... E04B 1/82

[52] U.S. Cl. ..... 181/286; 181/293

[58] Field of Search ..... 181/284, 285, 181/286, 288, 290, 292, 293, 294, 295, 210

[56] References Cited

U.S. PATENT DOCUMENTS

| | | | |
|---|---|---|---|
| 2,595,047 | 4/1952 | Beranek | 181/286 |
| 3,913,702 | 10/1975 | Wirt et al. | 181/286 |
| 4,113,053 | 9/1978 | Matsumoto et al. | 181/284 |
| 4,160,491 | 7/1979 | Matsumoto et al. | 181/286 |
| 5,457,291 | 10/1995 | Richardson | 181/293 |
| 5,760,349 | 6/1998 | Borchers et al. | 181/286 |

FOREIGN PATENT DOCUMENTS

| | | |
|---|---|---|
| 3913347 A1 | 10/1990 | Germany . |
| 3428157 A1 | 7/1992 | Germany . |
| 4011705 C2 | 7/1992 | Germany . |
| 4305281 C1 | 5/1994 | Germany . |
| 4241515 C1 | 6/1994 | Germany . |
| 2 090 334 | 7/1982 | United Kingdom . |

*Primary Examiner*—Khanh Dang
*Attorney, Agent, or Firm*—Gary M. Nath; Nath & Associates

[57] ABSTRACT

Sound absorber comprising a large number of tubular resonators (10) whose sound orifices $A_o$ are adjacent to a common surface A and are distributed in such a way that the interaction zones $A_w$ of these individual sound orifices $A_o$ are distributed as far as possible over the whole surface and at the same time do not substantially overlap. Preferred embodiments consist of extruded plastic shaped parts (16) or of metallic shaped parts (7, 9) which are firmly connected to one another and have suitable mechanical rigidity and acoustic hardness.

12 Claims, 5 Drawing Sheets

LAMBDA/4-WAVE SOUND ABSORBER

FIELD OF THE INVENTION

The invention relates to a sound absorber and in particular a sound absorber for vehicles, comprising several tubular resonators, preferably of different lengths.

BACKGROUND OF THE INVENTION

The modern automotive industry is striving to reduce or entirely eliminate the noises produced by vehicles. Today, essentially mats of fibrous insulating materials or open-pore foams are used for sound absorption and are mounted around the sources of noise or in the immediate vicinity thereof. However, the use of such open-pore sound absorbers in the engine space, as described, for example, in DE-34 28 157, proves to be problematic because they become contaminated with oil, water, dust and other impurities and thus rapidly decline in their acoustic effect.

For example, DE-40 11 705, DE-42 41 518 or DE-43 05 281 has therefore also already proposed providing an oil- and water-resistant arrangement comprising a large number of Helmholtz resonators. These known arrangements consist of box-like hollow bodies which have a hole or a neck. The volume of the hollow bodies together with the dimension of the hole or neck determines the resonant frequency of the absorber. These known arrangements are designed essentially for a frequency range from 1 to 2 kHz and can be mounted on the engine bonnet, in the wheel casing or on the floor.

These arrangements furthermore occupy an undesirably large amount of space, i.e. they cannot be used where there is a shortage of space.

When absorbers of this type are used in practice, the walls of the box-like hollow body must be light-weight, i.e. must be constructed very thin. However, these thin-walled hollow bodies tend to become deformed as a result of the acoustic pressure fluctuations and thus to limit the quality factor of the resonator. Since the quality factor plays a substantial role in determining the efficiency of the absorbers, it is also always necessary to accept a reduction in the acoustic efficiency of these absorbers when the light-weight construction method is used. The acoustic efficiency of these absorbers is in principle limited because the number of orifices which pick up the sound is limited by the geometric size of the individual hollow bodies. Typically, these hollow bodies have a base area of 15×15 $mm^2$ to 60×60 $mm^2$ in conjunction with an overall height of 5 to 25 mm and a hole diameter of 4 to 11 mm. It is therefore clear that these Helmholtz resonators can couple to the interfering sound field only to a limited extent since, when they are used extensively, the orifice area which is proportional to the quality factor Q and picks up the sound can be at most only 2.5% to 4% of the total area exposed to soundwaves. In addition, when the Helmholtz absorbers described are installed on a vehicle floor, the orifices are directed upwards and the cavities can therefore easily fill with moisture and dirt, which in turn impairs the sound absorption.

DE-39 13 347 also discloses an insulating part which has a large number of cell-like cavities which are arranged close together and are open on one side. By means of this insulating part, the energy of the incident sound field is essentially dissipated by irregular reflections, absorption in the material and interference effects. These insulating parts, too, are suitable only to a limited extent for use in automotive construction, in particular because they are readily soiled and, owing to their lack of intrinsic stability, rapidly wear out.

SUMMARY OF THE INVENTION

It is therefore the object of the present invention to provide a sound absorber which overcomes the disadvantages of known absorbers and in particular to provide a compact sound absorber which has improved sound absorption which remains effective even in the case of light-weight construction and in an environment subject to heavy soiling.

According to the invention, this object is achieved by a sound absorber comprising several tubular resonators, preferably of different lengths, at least one sound orifice of which is adjacent to a sound-reflecting surface. The tubular resonators may occupy any position relative to the sound-reflecting surface; in particular, the resonators may also rest on this surface.

If a soundwave front strikes a sound-reflecting surface, an acoustic pressure maximum forms directly in front of this surface. This acoustic pressure maximum is generated by the superposition of the incident and reflected waves at this point. In the arrangement according to the invention, the mouth of a tube is placed directly at such a sound-reflecting surface. The incident soundwave thus travels into the tube, is reflected at its end and travels back to the mouth orifice. Soundwaves whose wavelength is four times the length of the tube appear at the mouth orifice with a phase shift of a half wavelength. This leads to destructive interference with the wave of the same wavelength which is reflected in the mouth region of the tube, since the standing wave generated in the tube has its acoustic pressure minimum at the mouth orifice, while the wave reflected in the mouth region has its acoustic pressure maximum there. Thus, a steep acoustic pressure gradient is produced in the mouth region and contributes locally to high air flow velocities and hence to the desired dissipation of acoustic energy.

From this knowledge it is evident that the quarter-wave tubes can be arranged in any desired direction and also need not necessarily be linear. Furthermore, the cross-section of these tubes may have any desired shape. It is evident to a person skilled in the art to adapt the length of the tubes to the chosen shapes and resonant frequencies. For the sake of simplicity, however, a person skilled in the art will choose shapes having an essentially constant cross-sectional area.

What is essential for the effective functioning of the present invention is the formation of regions in which destructive interference occurs. These regions are referred to below as interaction zones $A_w$, the extent of which can be associated with the particular sound orifice area $A_o$ and the quality factor Q. It is in fact found that the ratio of the area of the interaction zone $A_w$ to the sound orifice area $A_o$ is proportional to the quality factor Q.

$$Q = k \cdot \frac{A_w}{A_o}$$

It is therefore the aim of the embodiments according to the invention to ensure that the individual interaction zones are as far as possible distributed over the whole surface and at the same time do not substantially overlap, since such overlap reduces the acoustic pressure gradient mentioned and hence decreases the dissipating local air currents. In order to achieve an acoustically effective arrangement of the interaction zones $A_w$ which as far as possible covers the whole surface, the orifices of the tubular resonators are preferably distributed at the apices of an imaginary net of isosceles triangles. If the sound absorption is desired over a broad frequency range, several groups of differently tuned tubular absorbers can be nested one into the other. The combination of the quarter-wave absorbers according to the invention with conventional absorbers may also be very useful for certain applications.

In the preferred field of use, the individual tubular resonators are tuned to a sound field in the range of 1–2 kHz, i.e. have a length of about 80–40 mm, corresponding to the quarter wavelength. Standing waves which are phase-shifted by a half wavelength relative to the wave front reflected in the mouth region and of the same wavelength and which interfere destructively with this wave front may form in these quarter-wave resonators. In order to be able effectively to absorb a vehicle-specific noise spectrum, the quarter-wave absorber according to the invention has at least one group of tubular resonators of different lengths. Whether the sound orifices are located in the end surface or in the lateral surface plays no significant role.

In a preferred embodiment, the individual resonators are distributed horizontally over a surface. The efficiency of the mechanism described depends essentially also on the sound-reflecting property of the material forming the cavity. Soft and flexible materials lead to losses during reflection and adversely affect the above absorption mechanism. It is therefore clear that only air-tight, smooth and acoustically hard materials, i.e. those which have good sound-reflecting properties, are suitable for the resonators according to the invention.

In a particular embodiment, the quarter-wave resonators are formed from a metal or plastic sheet. By arranging the resonators in groups, the latter can be fastened on the vehicle in the manner of tiles and oriented in such a way that any contaminating water or oil cannot be trapped, i.e. can flow out directly again. These sound absorbers according to the invention can be mounted by known means. By mounting the acoustically hard absorbers, vehicle parts which tend to oscillate and vibrate are additionally stiffened and damped.

In another embodiment, the cavities are formed directly in an acoustically hard matrix, preferably in a light-weight matrix of plastic, metal or ceramic.

The advantages of the apparatus according to the invention are directly evident to a person skilled in the art and lie in particular in the provision of a precisely tunable light-weight absorber of low overall height. In addition, this absorber can be used in environments exposed to heavy soiling, is not moisture-sensitive and can be produced economically. These properties prove to be a particular advantage in vehicle assembly. These sound absorbers can be immersed together with the vehicle chassis in a paint bath without contaminating the latter and without being damaged themselves.

BRIEF DESCRIPTION OF THE DRAWINGS

The invention is to be illustrated in more detail below with reference to embodiments and with the aid of Figures.

DETAILED DESCRIPTION

Figure 1A:
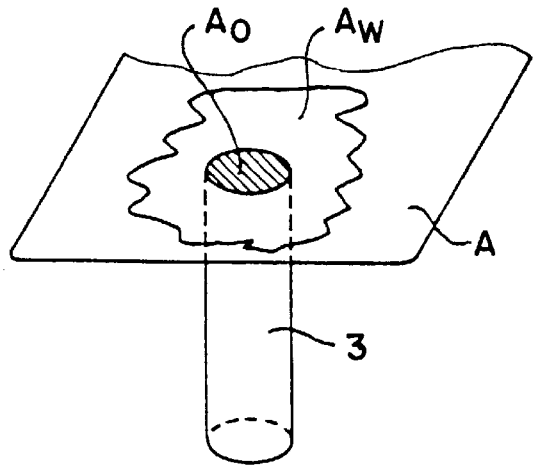
FIGS. 1*a–d* shows arrangements according to the invention between a tubular absorber and a sound-reflecting surface.
Figure 1B:
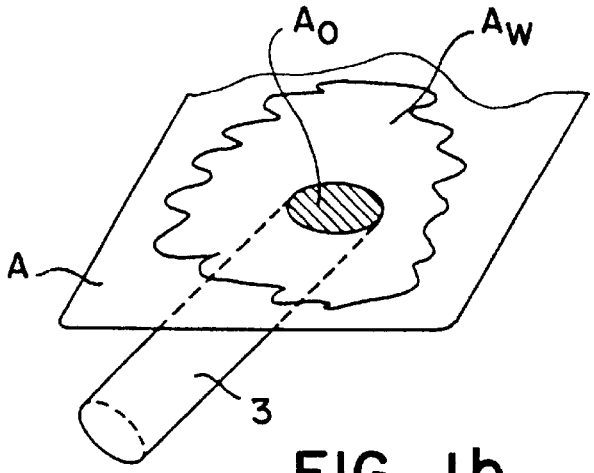
Figure 1C:
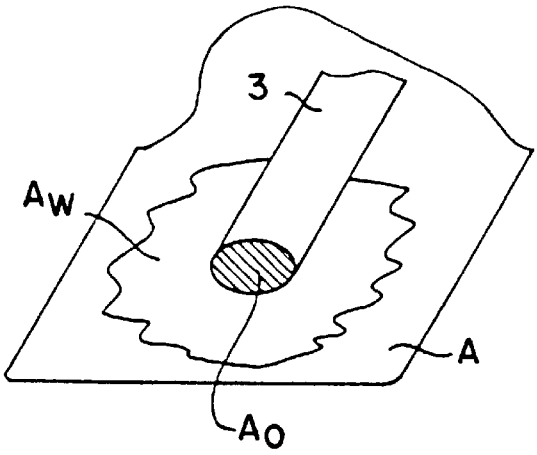
Figure 1D:
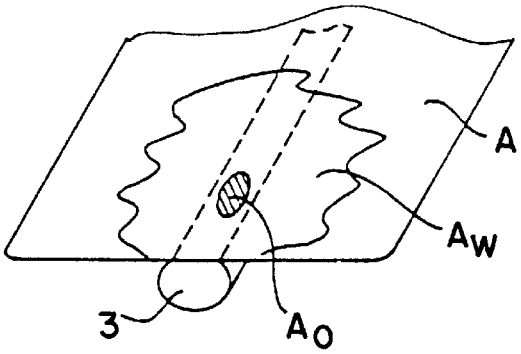

FIGS. 1*a* to 1*d* show the basic arrangement of the resonators in relation to the sound-reflecting surface A. In FIG. 1*a*, the quarter-wave resonator is perpendicular to the sound-reflecting surface A. Its mouth orifice $A_o$ lies in this surface A. It is possible to show experimentally that the sound absorption decreases in proportion to the extent to which the mouth orifice $A_o$ projects beyond the sound-reflecting surface A. According to the invention, however, the resonator 3 may also be inclined or imbricated relative to the sound-reflecting surface A. The design thickness of the total resonator can thus be reduced. This arrangement is appropriate in particular owing to its simple method of production and is suitable for use as a modular kit. The length of the individual resonators 3 and their diameters can be adapted to the desired absorption properties in a simple manner. A preferred arrangement is shown in FIG. 1*c*. Here, the resonators 3 lie parallel on the sound-reflecting surface A. This arrangement functions according to the invention, i.e. generates a strong air current in the region $A_w$. The arrangement shown in FIG. 1*d* corresponds to that in FIG. 1*c* but is easier to produce in practice. As shown in FIG. 1*c*, the sound orifice $A_o$ of the resonator 3 may be located in its end surface or, as shown in FIG. 1*d*, may be located in the lateral surface of the tubular resonator 3.

The cross-sectional area of the resonator 3 can of course have any desired shape and in particular the resonator 3 itself need not necessarily be linear but may also be curved.

Figure 2:
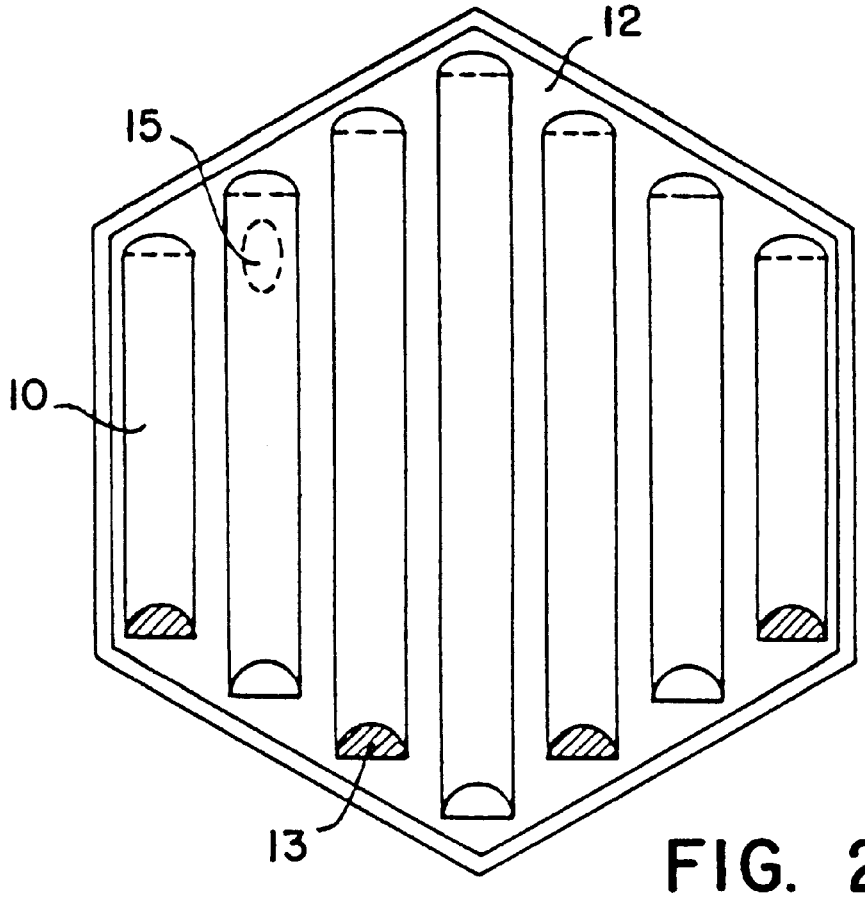
FIG. 2 shows a honeycomb-like embodiment of the apparatus according to the invention.

FIG. 2 shows a simple embodiment of the sound absorber according to the invention, in plan view. A group of resonators 10 are in the form of straight hollow bodies which have a sound orifice either in the end surface 13 or in the base 15. The honeycomb-like base surface 12 permits coating of the whole surface. In this embodiment which is about 100 mm wide, the individual resonators 10 have a length of 43 mm to 84 mm, i.e. are tuned to frequencies between 1 and 2 kHz. These quarter-wave absorbers can be produced, for example, from hard and smooth plastic or formed from metal sheets.

Figure 3A:
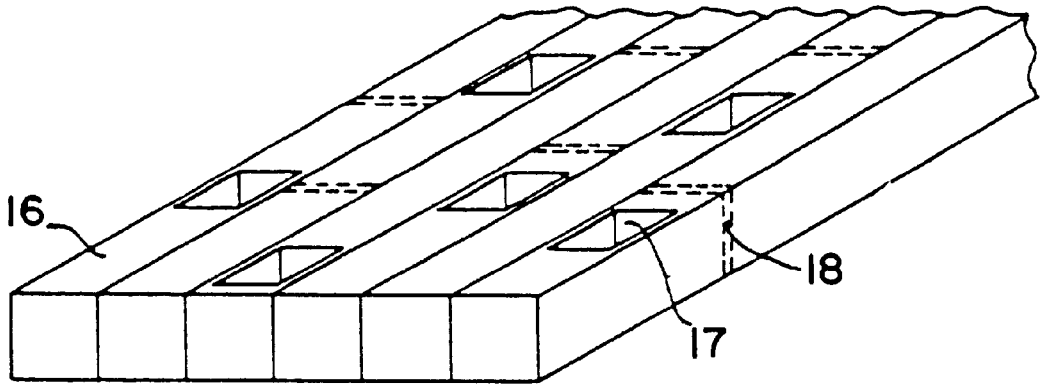
FIGS. 3*a, b* shows a flat embodiment of the apparatus according to the invention.

FIG. 3*a* shows a box-like embodiment comprising an extruded shaped plastic part 16. Here, the cross-section of the individual resonators 10 is approximately rectangular. The acoustically effective mouth orifices 17 are located in the lateral surface. In this embodiment, the end walls 18 of the resonators 10 can be displaced in the desired manner. This permits specific optimization of the acoustic absorption efficiency. Of course, these quarter-wave absorbers too can be arranged in several layers.

Figure 3B:
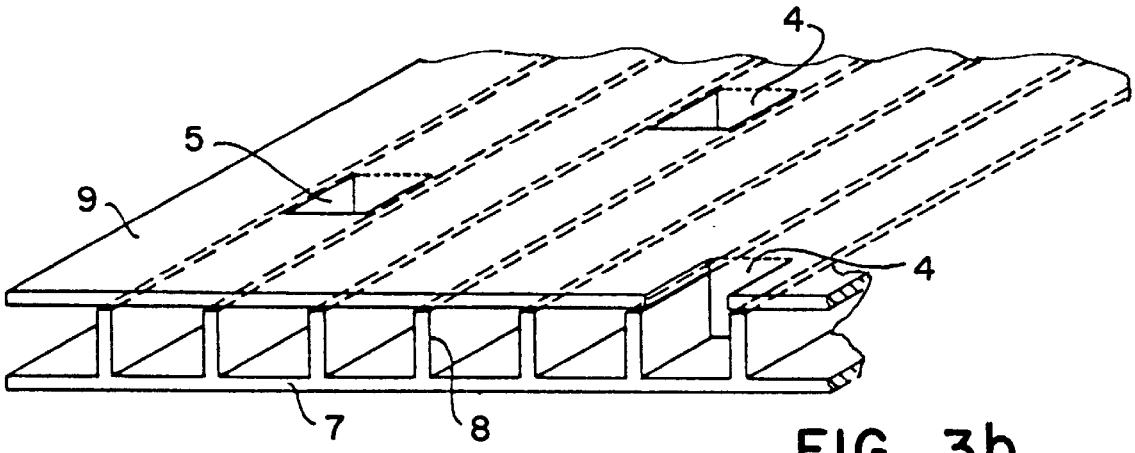

FIG. 3*b* shows an embodiment in which the resonators 16 are composed essentially of two shaped parts 7, 9. The first shaped part 7 is preferably made of aluminium and has ribs 8 parallel to one another. This shaped part 7 can be formed directly from aluminium foam or from an aluminium sheet. The ribs 8 of this shaped part 7 are covered by a second shaped part 9, in particular a foil or a sheet, preferably of aluminium, and together form the hollow bodies 6 according to the invention. The orifices 5 can be punched out of the second shaped part 9. In a simple procedure, parts of the second shaped part 9 are pressed into the hollow bodies 6, after joining of the two shaped parts 7, 9, so that resonator orifices 5 are produced and at the same time end walls 4 are formed between the individual resonators 6. However, the end walls 4 may also be formed directly in the first shaped part 7. Such an embodiment can be easily adapted to the particular desired contours and is therefore economical. It is clear that, by forming ribs and end walls in the first shaped part 7, the latter acquires high intrinsic mechanical rigidity, and the desired acoustic hardness can therefore also be achieved with relatively thin material.

Figure 4A:
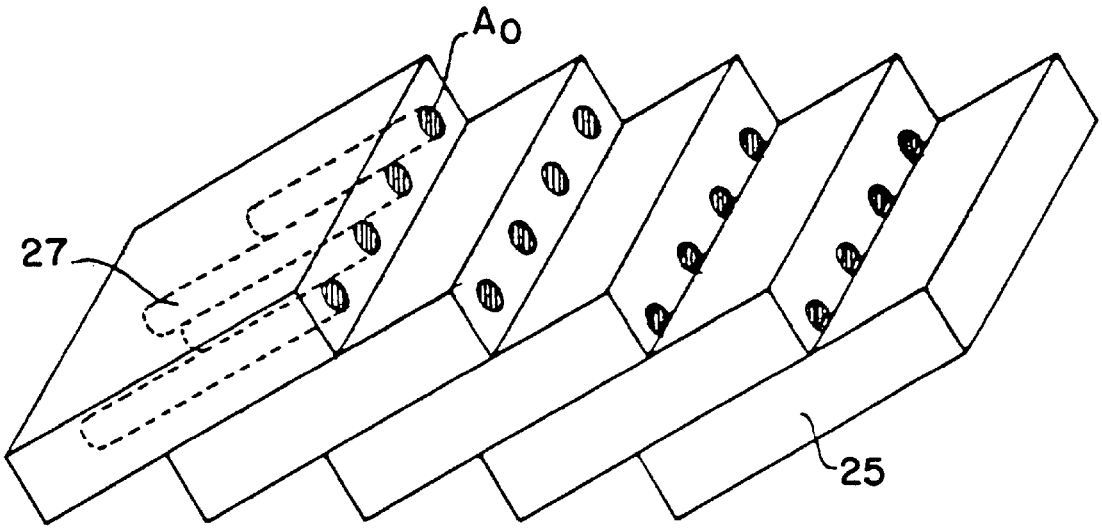
FIGS. 4*a, b* shows tile-like embodiments of the apparatus according to the invention.

FIG. 4*a* shows a further modular embodiment of the quarter-wave absorber according to the invention. This consists of block-like components 25 in which the tubular resonators 27 are located. These can be drilled out subsequently or can be formed directly by an appropriate injection moulding process. In a preferred embodiment, the cavities of the resonators 27 are parallel to the block geometry, and these blocks 25 are laid one on top of the other in the manner of roofing tiles during assembly and are fixed. It is clear that the optimal dimensioning of the tubular resonators 23 is within the abilities of a person skilled in the art. Various acoustically hard materials can be used for the production of these quarter-wave absorber blocks too. Thus, primarily only light-weight materials, such as rigid plastics, open-pore or closed-pore foams, in particular aluminium foam, coated papers or foils, in particular aluminium foils, are suitable for vehicle construction. For other applications, for example in building or road construction, the materials conventionally used there can of course be employed, provided that a smooth and acoustically hard surface within the resonators is ensured.

Figure 4B:
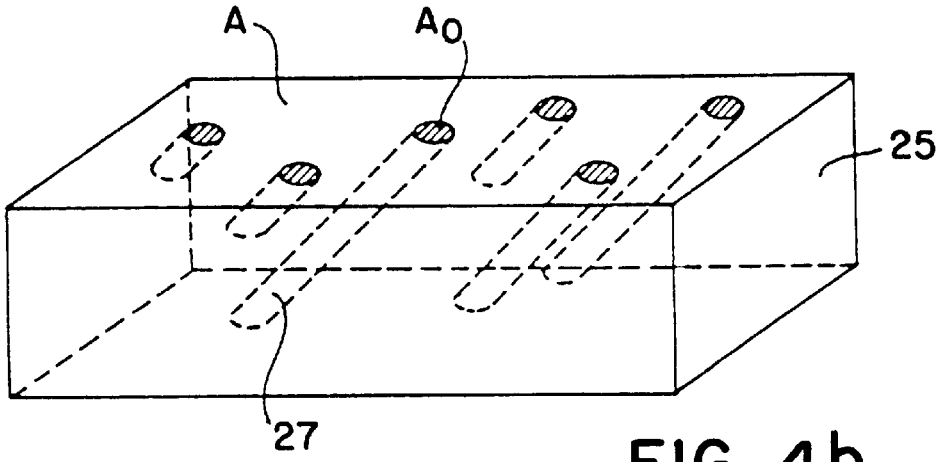

In a variant of this embodiment according to FIG. 4*b*, the resonators 27 are inclined relative to the block geometry. The angular positions of the individual resonators can of course differ from one another.

Figure 5:
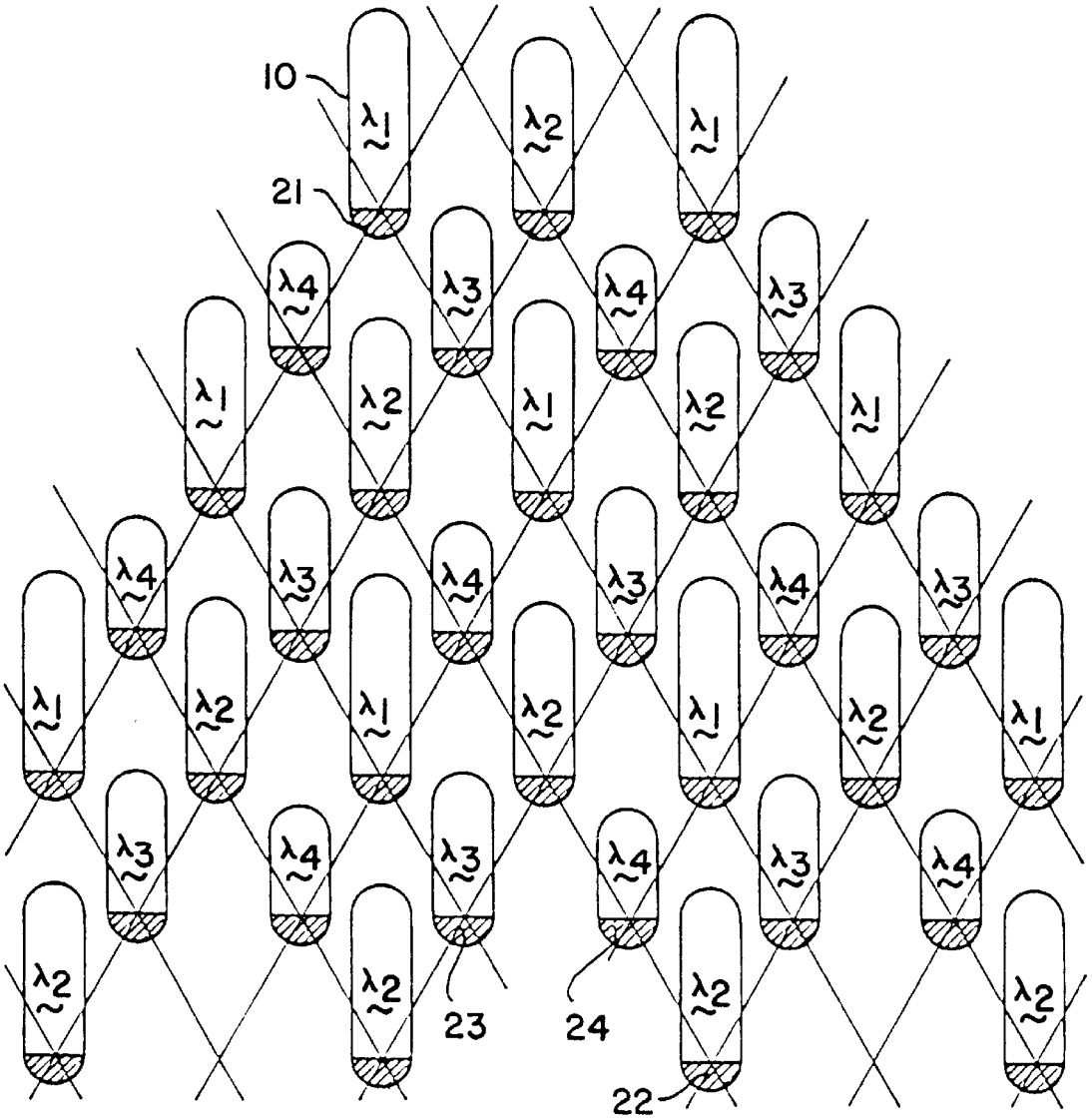
FIG. 5 shows a preferred distribution of resonators of different lengths.

FIG. 5 shows a schematic representation of the distribution of the resonators of different lengths. The sound orifices 21, 22, 23, 24 of the individual resonators each lie at the node of a net which is essentially based on isosceles triangles. FIG. 5 shows that, in this configuration, the interaction zones $A_w$ of the quarter-wave absorbers designed for a certain wavelength do not substantially overlap, and an extensive arrangement of the wavelength-dependent interaction zones $A_w$ is achieved.

It is evident that many different embodiments and fields of use will be considered by a person skilled in the art on the basis of the description of the mode of action. Thus, the reduction of vehicle noise externally is an important object, for which a person skilled in the art arranges sound absorbers in the immediate vicinity of the noise-producing units, in particular around the engine and the gear. The highest and hence most troublesome acoustic pressures are generated by these units in the frequency range of 1–2 kHz. If a value of 340 m/s is used for the sound propagation velocity, the relevant quarter-wave resonators are those having a length of 85–42.5 mm. Resonator groups in this length range and having a cross-sectional area of 0.25 to 2 $cm^2$ can be produced economically by shaping plastic or metal sheet in such a way that semitubular depressions are formed and this shaped sheet is mounted on, or adhesively bonded to, a support layer or support plate. Resonators formed in this manner are still acoustically hard even when thin foils are used, owing to the inherent rigidity of the curved surfaces, and have a high quality factor as resonators.

A further important field of use in the area of vehicle acoustics relates to the reduction of the interior noise produced in the vehicle cell. For this purpose, the resonators according to the invention or the above-mentioned foils provided with tubular depressions can be adhesively bonded to the inner surface of the panels or of the roof of, for example, trucks. The quarter-wave resonator foils additionally have stiffening effects and, with a suitable choice of the adhesive, also have a vibration-damping effect.

A particular technical problem in vehicle construction is associated with cavities which result from the special structure of the chassis. Special attention must be paid in particular to the cavities in doors, between metal panels and cladding. In this area, too, the quarter-wave absorber foil according to the invention can be mounted both on the door panel and on the door cladding. When adhesively bonded to the door panel, it is once again possible to benefit from the stiffening and vibration-damping effect.

In accordance with their design, the absorbers according to the invention are primarily suitable for applications in which the troublesome noise to be absorbed occurs in a limited frequency range. In particular, gears or toothed belts which run at constant speed, blowers of fans, electric motors or propeller engines in aircraft are sources of noise which have an exactly defined narrow frequency range.

The use of the absorbers according to the invention on sound-insulating walls, as sometimes erected along the sides of motorways, is mentioned here only in passing. The embodiments with the extruded sheet or the modular bricks would be particularly suitable for this purpose. An analogous use of the absorbers according to the invention is also possible for sound-absorbing linings of traffic tunnels. It is clear that the use of the absorbers according to the invention is not intended to be restricted to the vehicle sector. Thus, they can also be used in indoor swimming pools or sports halls or in factories as wall or ceiling cladding.

I claim:

1. Sound absorber for noise reduction in vehicles, comprising several tubular resonators, whose sound apertures are adjacent to a sound-reflecting surface, characterized in that, the respective sound apertures are spaced from each other at least by the radius of the corresponding interaction region ($A_w$), such that a destructive interference can occur between a wave reflected off the sound-reflecting surface and a wave being phased-shifted in the tubular-resonator, and such that the interaction regions do not substantially overlap other interaction regions, and that these interaction regions are distributed so as to cover the largest surface possible of the sound reflecting surface (A).

2. A sound absorber according to claim 1 wherein at least an inside surface of said resonator is a smooth surface.

3. A sound absorber for noise reduction having an interactive region causing destructive interference with sound waves comprising:

a sound-reflecting surface;

a resonator wherein sound waves are phase-shifted in said resonator;

a first sound aperture located on said resonator so that said sound aperture is adjacent to said sound-reflecting surface;

a first interaction region located above said first sound aperture wherein said first interaction region is defined by the characteristics of said sound absorber;

a second sound aperture located adjacent to said first sound aperture;

a second interaction region located above said second sound aperture; and said first sound aperture being located in a position apart from said second sound aperture by a distance of at least a radius of one of said interaction regions so that said first interaction region does not substantially overlap said second interaction region wherein said interaction regions are distributed to cover the largest surface possible of said sound-reflecting surface.

4. A sound absorber according to claim 3 having a plurality of resonators.

5. A sound absorber according to claim 4 wherein said resonators are of different lengths.

6. A sound absorber according to claim 3 wherein said first sound aperture is located in an end surface of said resonator.

7. A sound absorber according to claim 3 wherein said first sound aperture is located in a lateral surface of said resonator.

8. A sound absorber according to claim 3 wherein said sound apertures are of different sizes.

9. A sound absorber according to claim 3 wherein said resonator has an open bottom.

10. A sound absorber according to claim 3 wherein said resonator is parallel to said sound-reflecting surface.

11. A sound absorber according to claim 3 wherein said resonator is formed in an acoustically hard matrix or in acoustically hard shaped parts.

12. A sound absorber according to claim 11 wherein the acoustically hard matrix or each shaped part consists of plastic or a light metal.

* * * * *